US005511322A

United States Patent [19]

Fertig

[11] Patent Number: 5,511,322

[45] Date of Patent: Apr. 30, 1996

[54] PROCESS FOR TREATMENT OF AN OBJECT USING A FLOW OF HOT AIR AND HAND-HELD AIR BLOWER FOR CARRYING OUT THIS PROCESS

[75] Inventor: Werner Fertig, Bensheim, Germany

[73] Assignee: Wella Aktiengesellschaft, Darmstadt, Germany

[21] Appl. No.: 335,834

[22] PCT Filed: Feb. 3, 1994

[86] PCT No.: PCT/EP94/00611

§ 371 Date: Nov. 2, 1994

§ 102(e) Date: Nov. 2, 1994

[87] PCT Pub. No.: WO94/19983

PCT Pub. Date: Sep. 15, 1994

[30] Foreign Application Priority Data

Mar. 2, 1993 [DE] Germany ..... 43 06 429.9

[51] Int. Cl.[6] ..... A45D 20/00

[52] U.S. Cl. ..... 34/97; 34/202; 392/385

[58] Field of Search ..... 34/97, 202, 98–101; 392/383, 385, 379, 373

[56] References Cited

U.S. PATENT DOCUMENTS

| | | | |
|---|---|---|---|
| 4,876,435 | 10/1989 | Hawkins | 392/381 |
| 5,111,594 | 5/1992 | Allen | 34/202 |
| 5,163,234 | 11/1992 | Tsukamoto | 392/381 |
| 5,195,164 | 3/1993 | Lambert | 34/97 |
| 5,404,419 | 4/1995 | Artis, Jr. | 392/381 |

FOREIGN PATENT DOCUMENTS

| | | | |
|---|---|---|---|
| 2535853 | 2/1977 | Germany . | |
| 64700 | 3/1993 | Japan | 34/202 |

*Primary Examiner*—John T. Kwon
*Attorney, Agent, or Firm*—Michael J. Striker

[57] ABSTRACT

In a process for treating an object by a hot-air flow directed on the object by a hand-held air blower which is provided with a heating device and a fan, the heating device is controlled proportionally as a function of distance. The hand-held air blower has a distance detecting device for carrying out the process. The distance detecting device has an output for determined measured distance values. Proportional control signals for controlling the output control device are formed by a comparison device from the measured distance values and from a given temperature value of a temperature selector.

23 Claims, 5 Drawing Sheets

Fig.8
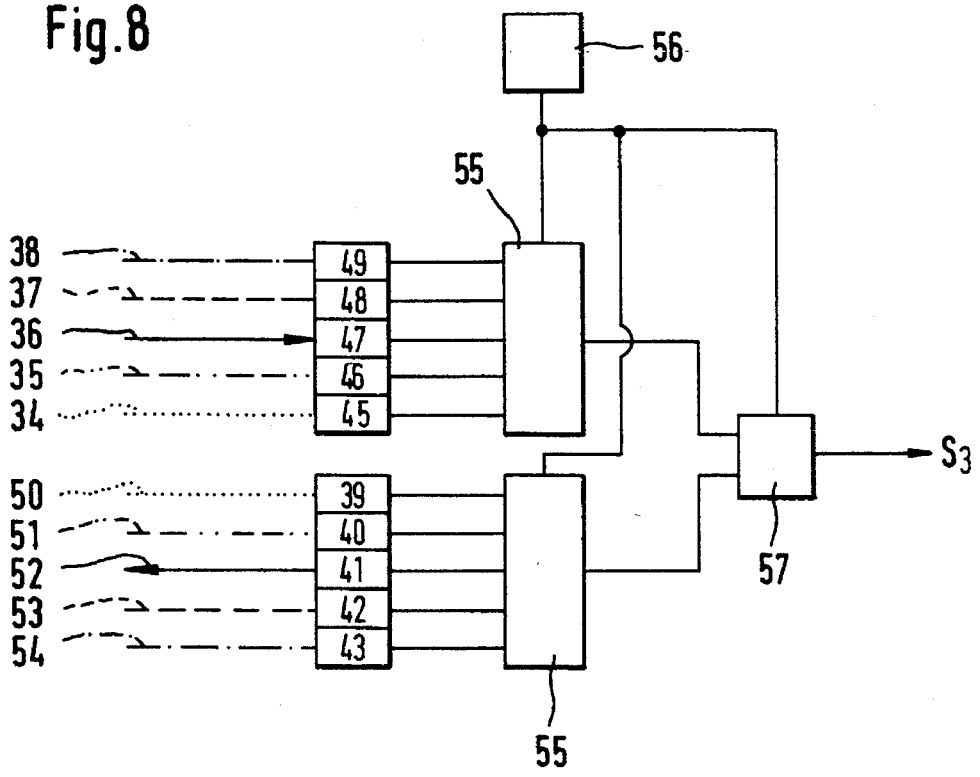
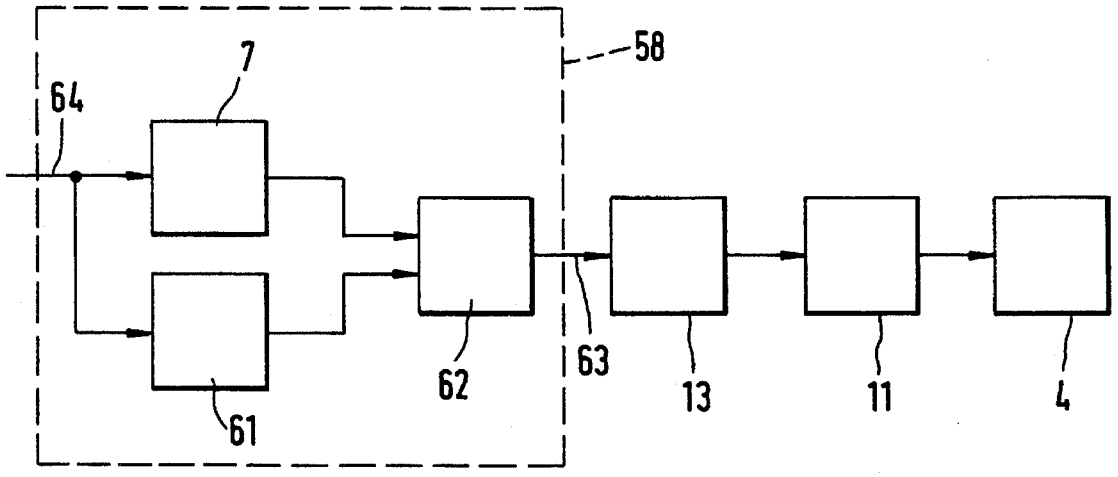
Fig.9

PROCESS FOR TREATMENT OF AN OBJECT USING A FLOW OF HOT AIR AND HAND-HELD AIR BLOWER FOR CARRYING OUT THIS PROCESS

BACKGROUND OF THE INVENTION

The invention is directed to a process for treatment of an object using a flow of hot air a hand-held air blower for carrying out this process.

A process for treatment of an object using a flow of hot air and a hand-held air blower for carrying out this process are known, e.g., from DE-A-25 35 853. A disadvantage of the known process and air blower consists in that the flow of hot air striking the object can have very widely differing high temperature values depending on the distance of the object from the hot air flow outlet opening of the hand-held air blower. Avoiding this disadvantage depends very much on the skill of the user of the hand-held air blower in maintaining the required distance with respect to the desired temperature of the hot air flow striking the object, the desired temperature being determined by feel. This is made even more difficult when various heat outputs are adjusted, since this necessarily changes the required distance.

SUMMARY OF THE INVENTION

Therefore, the object of the present invention is to provide a process for the treatment of an object using a flow of hot air and a hand-held air blower for carrying out this process which do not have the disadvantages mentioned above and in which the given temperature of the hot air flow striking the object can automatically be maintained at least approximately constant substantially independent from the distance between the object and the hot air outlet opening.

With these objects and with others which will become apparent hereinafter, one feature of the present invention resides, briefly stated, in a process for treating an object by a hot air flow directed on the object by a hand-held air blower provided with a heating device and a fan, in accordance with which the heating device is controlled proportionally as a function of distance between the air blower and the object.

In accordance with another feature of the present invention a hand-held air blower with a heating device is provided, wherein the hand-held air blower has a distance detecting device which has an output for determined measured distance values, proportional control signals for controlling an output control device are formed by a comparison device from the measured distance values and from a given temperature value of a temperature selector, and the output control device controls the heating device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 8 is a block diagram of the device according to FIG. 7;

FIG. 9 is a block diagram of a device for detecting the size of an object.

DESCRIPTION OF THE PREFERRED EMBODIMENTS

Figure 1:
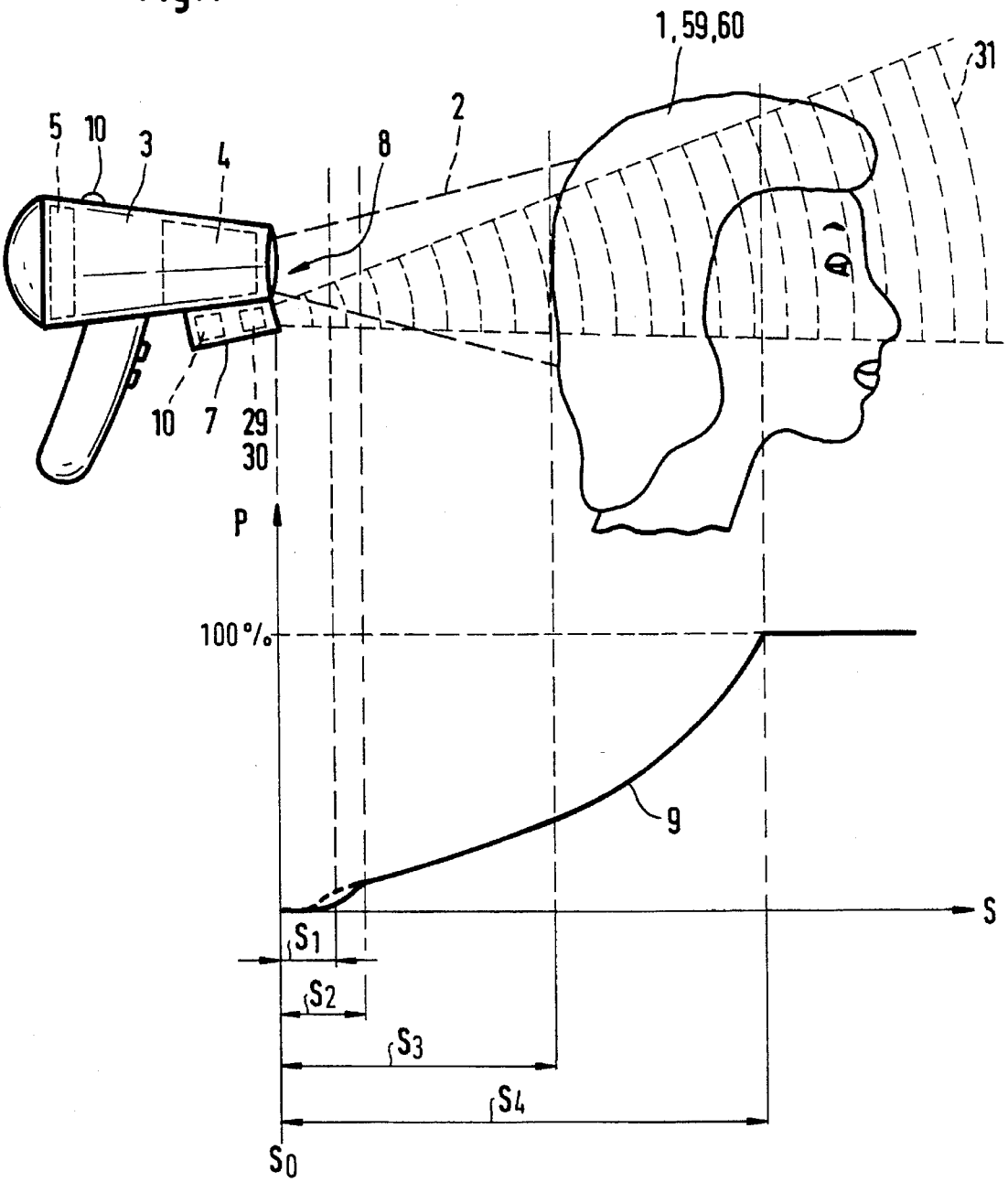
FIG. 1 shows the basic operation of the process and hand-held air blower.

FIG. 1 illustrates the basic operation of the process for treating an object 1 by a hot-air flow 2 directed on the object 1 by a hand-held air blower 3 which is provided with a heating device 4 and a fan 5. The heating device 4 is controlled in proportion to distance S so that a given temperature of the hot-air flow 2 on the object 1 remains constant substantially independent from the distance between the hot-air outlet opening 8 of the hand-held blower 3 and the object 1. In an embodiment example, the heating device 4 is controlled by distance measurement values $S_1$, $S_2$, $S_3$, $S_4$ of a distance detecting device 7. The principle of sound transit time, as is described, e.g., in WO 91/18534, can be used for detecting the distance S. However, in an independent further development of the invention, a reflected light process according to FIGS. 7 and 8 can also be used.

The relationship between heat output P and distance S at a given temperature is shown in the graph. The slope of the curve 9 (heat output P changes at a square function to the distance) depends upon the maximum heat output $P_1$ of a hand-held air blower 3. The maximum detection range $S_4$ is determined by the maximum heat output $P_1$ (=100%). In close range $S_1$–$S_0$, it is advantageous when the heat output $P_2$ is controlled so as to be disproportionately smaller relative to distance S, since the intensity of the hot-air flow 2 contributes disproportionately to drying in close range. The distance detecting device 7 is coupled with a signal device 10 to alert the user of the hand-held air blower 3 that the given detection range $S_4$ has been exceeded. In a further development, the heating device 4 is switched off when the detection range $S_4$ is exceeded. In practice, it is advantageous to switch off the heating device with a delay if the object 1 is not found within the detection range $S_4$ again within a given period of time (e.g., 5 seconds). In order to bring the drying effect more in line with the distance S, particularly in the close range $S_0$–$S_1$, the fan 5 is also controlled in proportion to distance S. A further coordination of the drying effect with the distance S is achieved in that the heat output P is changed in proportion to the size D of the object 1 to be treated, since a smaller object 1 requires less heat output P (and less hot-air flow 2) than a larger object 1 given the same distance $S_4$.

Figure 2:
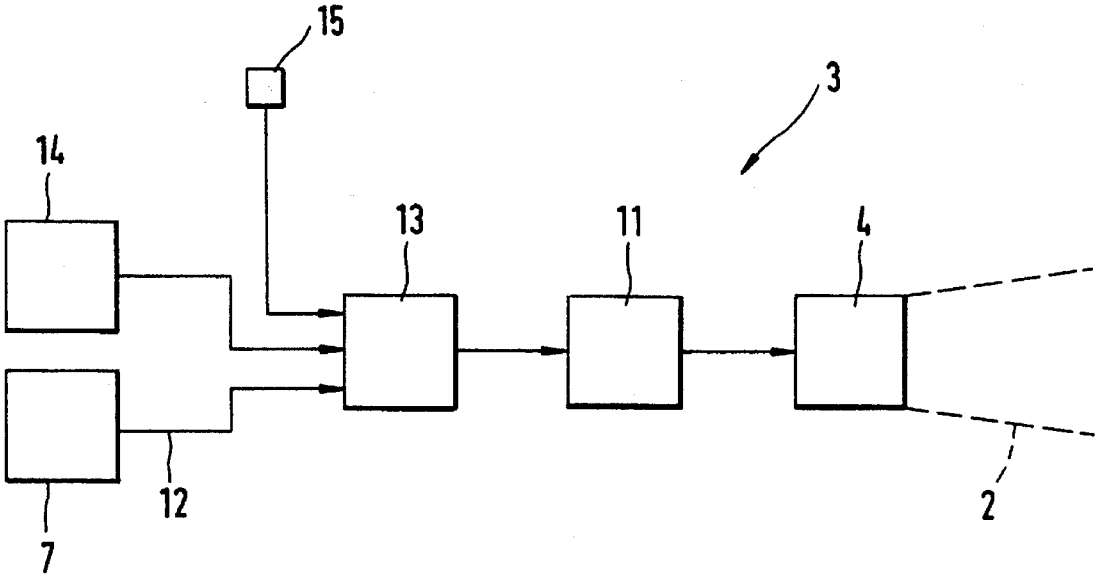
FIG. 2 is a block diagram illustrating the control of a heating device.

FIG. 2 is a block diagram showing a hand-held air blower 3 with a heating device 4 connected with an output control device 11 and a fan 5 (FIG. 1) for treating an object 1 by a hot-air flow 2 directed to the object. The hand-held air blower 3 is provided with a distance detecting device 7 which has an output 12 for determined measured distance values $S_1$, $S_2$, $S_3$, $S_4$. Proportional control signals for controlling the output control device 11 are formed by a comparison device 13 from the measured distance values $S_1$, $S_2$, $S_3$, $S_4$ and from a given temperature value of a temperature selector 14. The comparison device 13 is connected with an ambient-temperature gauge 15 to take into account the ambient temperature and fluctuations therein.

Figure 3:
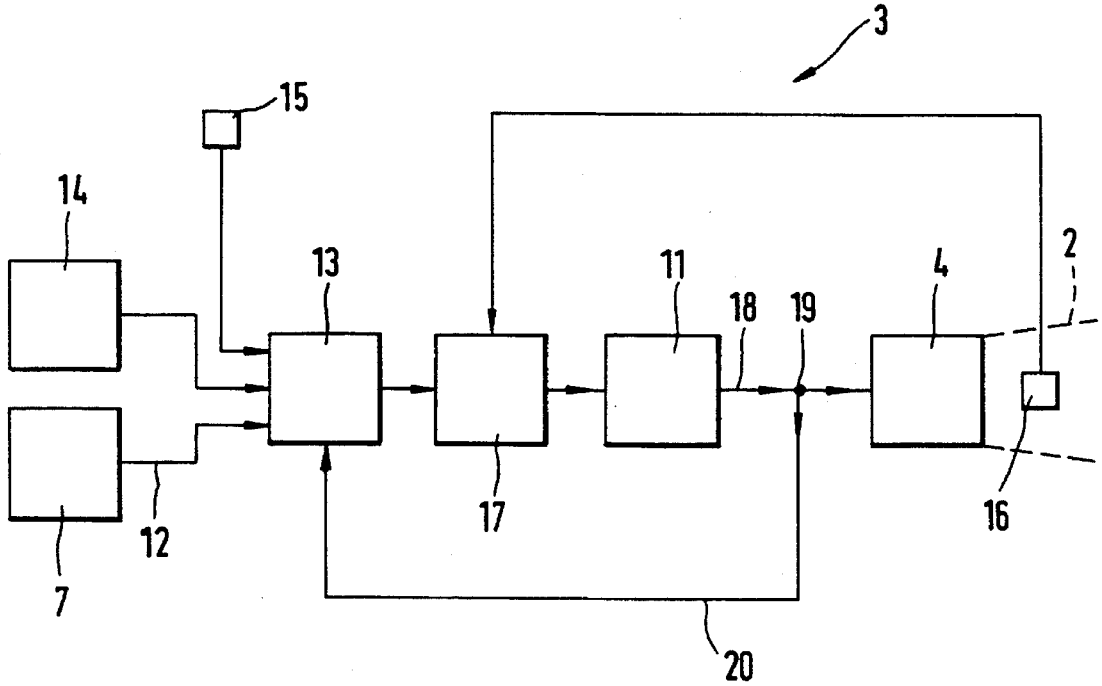
FIG. 3 is a block diagram showing the regulating of a heating device.

According to FIG. 3, a suitable hot-air temperature gauge 16 connected with a regulator 17 is provided for adjusting the hot-air temperature at the hot-air outlet opening 8 to the temperature value determined by the comparison device 13. For this purpose, an output signal 18 of the power or output control device 11 is degeneratively fed back to the comparison device 13 at a branch point 19 via a negative-feedback path 20, the hot-air temperature at the outlet opening 8 being regulated to the temperature value determined by the comparison device 13. The given temperature value is adjusted in an appropriate manner depending on the ambient temperature. The respective allowed temperature value is integrated in the comparison device 13 as a table and is derived from the parameters of the temperature selector 14, the distance to the object 1, the ambient temperature and the maximum heat output P.

Figure 4:
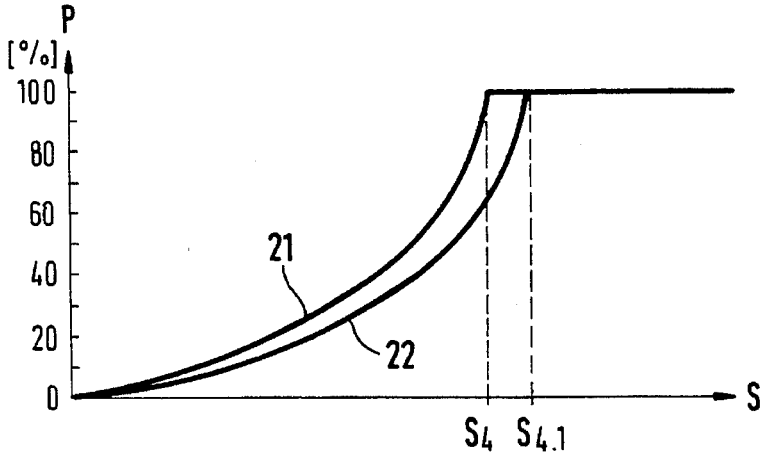
FIG. 4 shows a graph of heat output as a function of distance.

The graph according to FIG. 4 shows an appropriate curve 21 for high hot-air temperature and a curve 22 for a lower hot-air temperature. This graph clearly shows that the detection range $S_{4.1}$ (e.g., 55 cm) is greater at a lower hot-air flow temperature than at a higher temperature (e.g., $S_4$=50 cm). Therefore, a high heat output 8, e.g., 2,000 watts or more, is required for a large detection range $S_4$.

Figure 5:
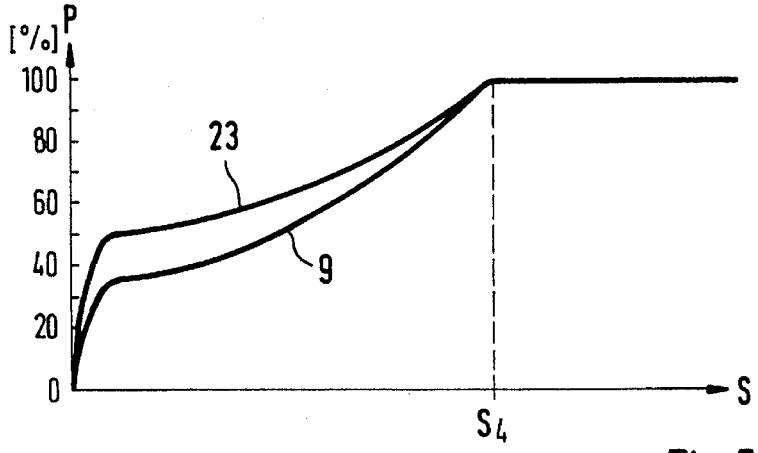
FIG. 5 shows a graph of heat output and blowing output as a function of distance.

The graph in FIG. 5 shows a curve 9 of heat output P as a function of distance S and, in proportion to this, a curve 23 of the output control of the fan 5 so that a more suitable drying of hair is achieved.

Figure 6:
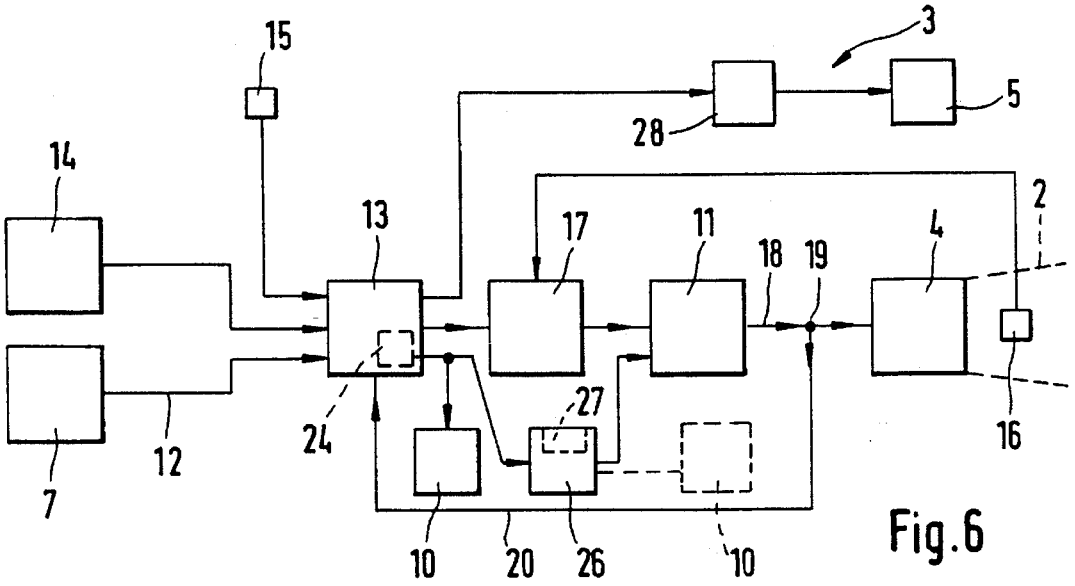
FIG. 6 is a block diagram similar to that in FIG. 3, but, in addition, with a device for detecting whether or not a distance detection range has been exceeded.

In FIG. 6, a device 24 for detecting whether or not the distance detection range $S_4$ has been exceeded is provided in addition to the hand-held air blower 3 shown in FIG. 3. The device 24 which is coupled with a signal device 10 is integrated in the comparison device 13 in the form of a table. When the detection range $S_4$ is exceeded, the heating device 4 can be switched off in an advantageous manner only when the object 1 is not found within the detection range $S_4$ within a given period of time. This can be achieved in that a time delay device 26 is provided with a resetting device 27 which is activated when the object 1 is located within the detection range $S_4$ within a given period of time. To this end, the time delay device 26 is connected on the one hand with the device 24 for detecting whether not the detection range has been exceeded and, on the other hand, with the output control 11. When the signal device 10—as indicated in dashed lines—is connected with the output of the time delay device 26, a signal is first generated when the heating device 4 is switched off. The fan 5 can be controlled by a blower control device 28, also proportionally, parallel to the controlling/regulating of the heating device 4.

The distance detecting device 7 according to FIG. 1 can be provided with an ultrasonic transmitter 29 and an ultrasonic receiver 30, the transit time of the reflected ultrasonic waves 31 being used for measuring the (relative) distance S.

Figure 7:
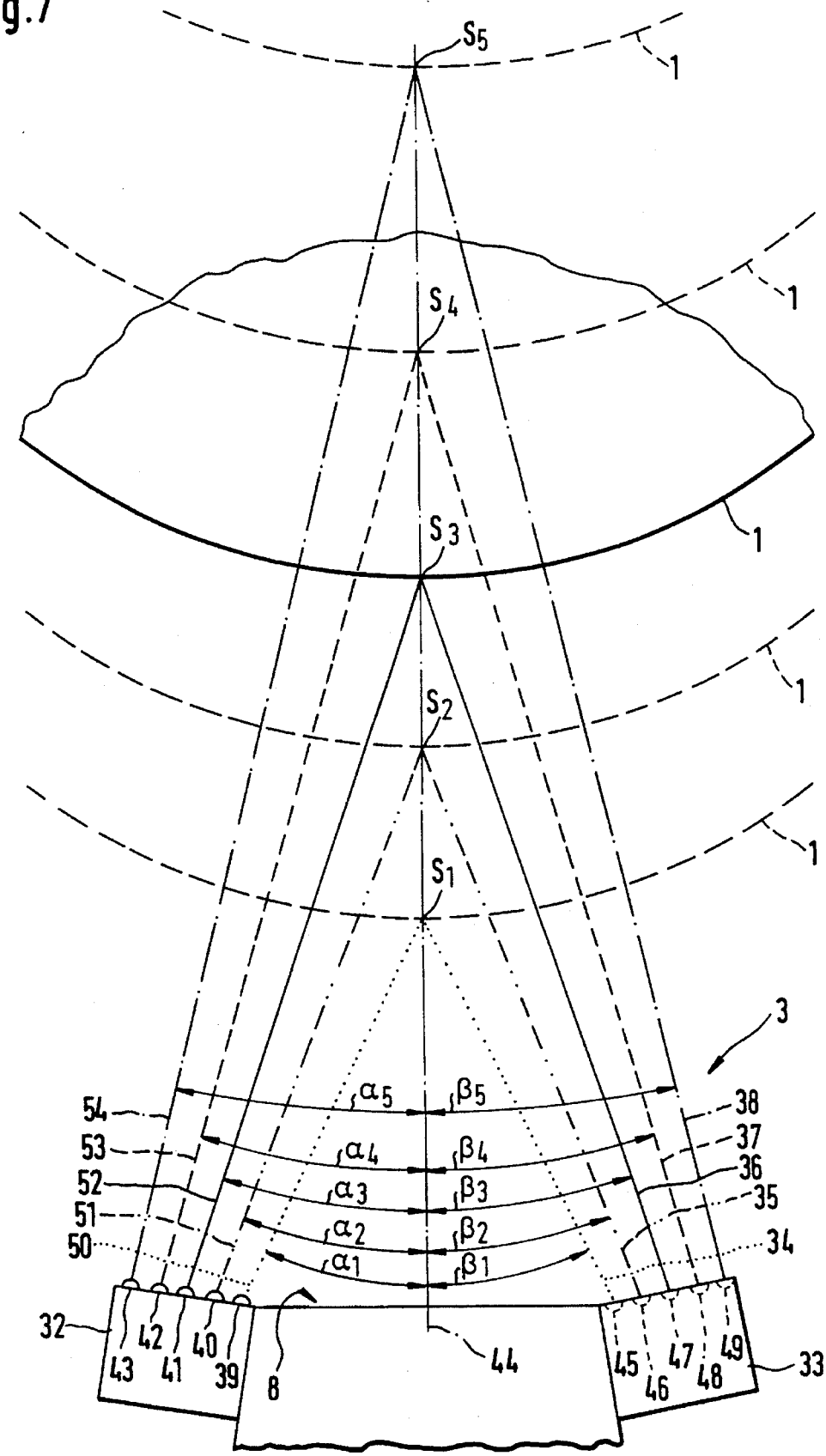
FIG. 7 shows a distance detecting device.

An independent embodiment example of the distance detecting device 7—not dependent upon its application in a hand-held air blower, etc.—using an infrared light transmitter 32 and a reflected infrared light receiver 33 is shown in FIG. 7. The principle used in detecting distance consists in that the transmitter 32 and receiver 33 are arranged at a base distance from one another and the IR light beams 34 . . . 38 reflected by an object 1 are selectively identified on the basis of their light intensity and are associated with a determined distance $S_1$, $S_2$, $S_3$, $S_4$, $S_5$. This may be realized, for example, by providing the transmitter 32 with a series of IR transmitting diodes 39 . . . 43, each of which is aligned relative to the center axis 44 at a determined angle of incidence $alpha_1$ . . . $alpha_5$ and corresponding IR receiving diodes 45 . . . 49 are aligned relative to the center axis 44 at identical angles (of reflection) $beta_1$ . . . $beta_5$. When an object 1 is located at a distance $S_3$, the IR light beam 52 is reflected and strikes the IR receiving diode 47 as a reflected IR light beam 36 so that the receiving diode 47 detects a distance $S_3$ of the object 1.

For the purpose of improved protection against interference and more precise measurement of distance, the IR transmitting diodes 39 . . . 43 and the IR receiving diodes 45 . . . 49 are cyclically controlled synchronously in time multiplexing process (FIG. 8). For this purpose, the multiplexer 55 and comparator 57 are clocked synchronously by a timer 56. When a maximum signal value is determined at a certain clock pulse, the comparator 57 allocates an appropriate distance S to this clock pulse. In the present example, the reflected IR light beam 36 is identified as a maximum value and assigned a distance $S_3$. In the event of two adjacent maximum values, the comparator 57 associates them with a corresponding mean value of distance S. It will be understood that a more sensitive distance measurement can be carried out by increasing the number of IR transmitting diodes and IR receiving diodes.

In connection with the ultrasonic method, the receiver signals 64 are fed to the distance detecting device 7 and to a signal intensity detecting device 61 as object size detection device 58. An object size detection logic 62 calculates a corresponding object size signal 63 from the determined distance S and signal intensity by means of tables, this object size signal 63 being fed to the comparison device 13—in connection with the examples according to FIG. 2 or 3 or 6—for controlling/regulating the heating device 4 via the output control device 11.

It will be understood that each of the elements described above, or two or more together, may also find a useful application in other types of methods and constructions differing from the types described above.

While the invention has been illustrated and described as embodied in a process for treatment of an object using a flow of hot air and hand-held air blower for carrying out this process, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A process for treating an object by a hot air flow directed on the object by a hand-held air blower provided with a heating device and a fan, comprising the steps of determining a distance between the air blower and the object; and controlling the heating device proportionally as the function of the thusly determined distance so that a given temperature of hot air flow on the object remains constant substantially independent from the distance between the air blower and the object.

2. A process as defined in claim 1, wherein said determining includes using a distance detecting device which produces measured distance values, said controlling including controlling the heating device in accordance with the measured distance values.

3. A process as defined in claim 1, wherein said controlling includes controlling the heating device so that a heat output of the heating device decreases disproportionally at a relatively small distance from the air blower to the object.

4. A process as defined in claim 2; and further comprising the steps of coupling a signal device to the distance detecting device so that the signal device is activated when a given detection range of the distance detecting device is exceeded.

5. A process as defined in claim 2; and further comprising the step of coupling the heating device with the distance detecting device so that the heating device is switched off when a detection range of the distance detecting device is exceeded.

6. A process as defined in claim 1; and further comprising the step of switching off of the heating device after a delay when the object is not found within a detection range of the distance detecting device again within a given period of time.

7. A process as defined in claim 1, wherein said controlling includes controlling the air blower in proportion to the distance in a close range of the distance between the air blower and the object.

8. A process as defined in claim 1; and further comprising the step of changing a heat output of the fan of the air blower depending on a size of the object.

9. A hand-held air blower, comprising a heating device; a fan connected with said heating device for treating an object by a hot air, flow directed on the object; a distance detecting device providing measured distance values of a distance between the air blower and the object; and a control device for controlling said heating device proportionally to the measured distance values so that a given temperature of a hot air flow on the object remains constant substantially independent from the distance between the air blower and the object.

10. A hand-held air blower as defined in claim 9; and further comprising a signal device coupled with said distance detecting device and generating a signal when a given detection distance has been exceeded.

11. A hand-held air blower as defined in claim 9, wherein said heating device is connected with said distance detecting device so that said heating device is switched off when a detection range of said distance detecting device has been exceeded.

12. A hand-held air blower as defined in claim 9, wherein said control device includes a fan control which is controlled by the control signals.

13. A hand-held air blower as defined in claim 9, wherein said distance detecting device is provided with an ultrasonic transmitter and an ultrasonic receiver such that a transit time of reflected ultrasonic waves is used for measuring the distance between the air blower and the object.

14. A hand-held air blower as defined in claim 13, wherein said transmitter and said receiver are formed so that said transmitter can operate as a receiver and vice versa.

15. A hand-held air blower as defined in claim 9, wherein said distance detecting device includes an infrared light transmitter and a reflected infrared light receiver.

16. A hand-held air blower as defined in claim 13, wherein said ultrasonic transmitter and receiver are formed so that ultrasonic waves are encoded.

17. A hand-held air blower as defined in claim 15, wherein said infrared light transmitter and receiver are formed so that an infrared light is encoded.

18. A hand-held air blower as defined in claim 9; and further comprising an object size detecting device connected with said control device so that a heat output of said heating device is changed proportionally depending on a size of the object detected by said object size detecting device.

19. A hand-held air blower, comprising a heating device; a fan connected with said heating device for treating an object by a hot air flow directed on the object; a distance detecting device providing measured distance values of a distance between the air blower and the object; and a control device for controlling said heating device proportionally to the measured distance values, said control device including a temperature selector having a given temperature value, a comparison device forming proportional control signals from the measured distance values and from the given temperature value of said temperature selector, and an output control device which is controlled by said proportional control signals.

20. A hand-held air blower as defined in claim 19; and further comprising an ambient temperature gauge, said comparison device being connected with said ambient temperature gauge.

21. A hand-held air blower as defined in claim 19; and further comprising a hot air temperature gauge provided for detecting a temperature of a hot air at an air outlet opening of the blower; and a regulator connected with said hot air temperature gauge for regulating the temperature of the hot air at the air outlet opening to a temperature value allowed by said comparison device.

22. A hand-held air blower, comprising a heating device; a fan connected with said heating device for treating an object by a hot air flow directed on the object; a distance detecting device providing measured distance values of a distance between the air blower and the object; a control device for controlling said heating device proportionally to the measured distance values; and a time delay device via which a power of the blower is cut off when the object is not found within the detection range of said distance detecting device within an allowed period of time.

23. A hand-held air blower as defined in claim 22, wherein said time delay device is provided with a resetting device which is activated when the object is found within the detection range of said distance detecting device within an allowed period of time.

* * * * *